US010957524B1

(12) United States Patent
McCauley

(10) Patent No.: US 10,957,524 B1
(45) Date of Patent: Mar. 23, 2021

(54) MULTIPOLE ASSEMBLY WITH GALVANIC PROTECTION FOR USE IN A MASS SPECTROMETER

(71) Applicant: Thermo Finnigan LLC, San Jose, CA (US)

(72) Inventor: Edward B. McCauley, Cedar Park, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/684,196

(22) Filed: Nov. 14, 2019

(51) Int. Cl.
*H01J 49/02* (2006.01)
*H01J 49/42* (2006.01)

(52) U.S. Cl.
CPC ..... *H01J 49/022* (2013.01); *H01J 49/4215* (2013.01)

(58) Field of Classification Search
CPC ..... H01J 49/022; H01J 49/4215
See application file for complete search history.

(56) References Cited

U.S. PATENT DOCUMENTS

2018/0174817 A1* 6/2018 Green ..... H01J 49/4255

OTHER PUBLICATIONS

Holzer et al. "Corrosion of Molybdenum in Cooling Water" 18th Pansee Seminar 2013, 13 pages.

* cited by examiner

*Primary Examiner* — Nicole M Ippolito
*Assistant Examiner* — Hanway Chang

(57) ABSTRACT

A multipole assembly configured to be disposed in a mass spectrometer includes a plurality of rod electrodes. Each rod electrode included in the plurality of rod electrodes may be made of molybdenum. The multipole assembly further includes a sacrificial anode in electrical contact with a rod electrode included in the plurality of rod electrodes. The sacrificial anode is made of a material having an electrochemical potential that is more negative than the electrochemical potential of the rod electrode.

20 Claims, 11 Drawing Sheets

MULTIPOLE ASSEMBLY WITH GALVANIC PROTECTION FOR USE IN A MASS SPECTROMETER

BACKGROUND INFORMATION

A mass spectrometer is an analytical tool that may be used for qualitative and/or quantitative analysis of a sample. A mass spectrometer generally includes an ion source for generating ions from the sample, a mass analyzer for separating the ions based on their ratio of mass to charge, and an ion detector for detecting the separated ions. The mass spectrometer uses data from the ion detector to construct a mass spectrum that shows a relative abundance of each of the detected ions as a function of their ratio of mass to charge. By analyzing the mass spectrum generated by the mass spectrometer, a user may be able to identify substances in a sample, measure the relative or absolute amounts of known components present in the sample, and/or perform structural elucidation of unknown components.

A mass spectrometer may include one or more multipole assemblies having a plurality of electrodes for use in guiding, trapping, and/or filtering ions. As an example, a multipole assembly may be a quadrupole having four rod electrodes arranged as two opposing pairs. Opposite phases of radio-frequency (RF) voltage may be applied to the pairs of rod electrodes, thereby generating a quadrupolar electric field that guides or traps ions within a center region of the quadrupole. In quadrupole mass filters, a mass resolving direct current (DC) voltage may also be applied to the pairs of rod electrodes, thereby superimposing a DC electric field on the quadrupolar electric field and causing a trajectory of some ions to become unstable and causing the ions to discharge against one of the rod electrodes. In such mass filters, only ions having a certain ratio of mass to charge maintain a stable trajectory and are subsequently detected by the ion detector.

When a multipole assembly is used in a mass spectrometer, an imprecise electric field generated by the multipole assembly may cause poor transmission of ions and result in diminished resolution, sensitivity, and/or mass accuracy.

SUMMARY

The following description presents a simplified summary of one or more aspects of the methods and systems described herein in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects of the methods and systems described herein in a simplified form as a prelude to the more detailed description that is presented below.

In some exemplary embodiments, a multipole assembly configured to be disposed in a mass spectrometer comprises a plurality of rod electrodes, each rod electrode included in the plurality of rod electrodes comprising molybdenum, and a sacrificial anode in electrical contact with a rod electrode included in the plurality of rod electrodes, wherein the sacrificial anode comprises a material having an electrochemical potential that is more negative than the electrochemical potential of the rod electrode.

In some exemplary embodiments, the material comprises at least one of magnesium, aluminum, and zinc.

In some exemplary embodiments, the material comprises at least one of chromium, iron, nickel, and an alloy thereof.

In some exemplary embodiments, the sacrificial anode is in physical contact with a side surface of the rod electrode.

In some exemplary embodiments, the sacrificial anode comprises a washer and is attached to the rod electrode by a screw.

In some exemplary embodiments, an electrical lead is electrically connected to the rod electrode and configured to supply a radio frequency voltage to the rod electrode, wherein the sacrificial anode is disposed between the rod electrode and the electrical lead.

In some exemplary embodiments, a support member is configured to hold the plurality of rod electrodes, wherein each rod electrode included in the plurality of rod electrodes is secured to the support member by a screw, and the support member is disposed between the rod electrode and the sacrificial anode.

In some exemplary embodiments, a plurality of sacrificial anodes are in electrical contact with the plurality of rod electrodes, the plurality of sacrificial anodes including the sacrificial anode.

In some exemplary embodiments, the plurality of rod electrodes includes a first pair of rod electrodes including the rod electrode and a second rod electrode positioned opposite to the rod electrode and electrically connected to the rod electrode, and a second pair of electrodes including a third rod electrode and a fourth rod electrode positioned opposite to the third rod electrode and electrically connected to the third rod electrode, and the multipole assembly further comprises an additional sacrificial anode in electrical contact with the third rod electrode.

In some exemplary embodiments, the multipole assembly is included in an ion guide, a mass filter, a collision cell, or an ion trap.

In some exemplary embodiments, the multipole assembly comprises a quadrupole, a hexapole, or an octapole.

In some exemplary embodiments, a mass spectrometry system comprises a multipole assembly comprising a plurality of rod electrodes, each rod electrode included in the plurality of rod electrodes comprising molybdenum; and a sacrificial anode in electrical contact with a rod electrode included in the plurality of rod electrodes, wherein the sacrificial anode comprises a material having an electrochemical potential that is more negative than the electrochemical potential of the rod electrode.

In some exemplary embodiments, the mass spectrometry system further comprises an ion source configured to produce ions from a sample, a mass analyzer configured to filter the ions produced from the sample, and a detector configured to detect ions delivered from the mass analyzer.

In some exemplary embodiments, the multipole assembly comprises an ion guide included in the ion source.

In some exemplary embodiments, the multipole assembly comprises a mass filter or a collision cell included in the mass analyzer.

In some exemplary embodiments, a method includes disposing a sacrificial anode in electrical contact with a rod electrode of a multipole assembly, the rod electrode including molybdenum, the sacrificial anode having a first electrochemical potential, the rod electrode having a second electrochemical potential, and the first electrochemical potential being more negative than the second electrochemical potential; and disposing an electrical lead in electrical contact with the rod electrode, the sacrificial anode being positioned between the rod electrode and the electrical lead.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements. Furthermore, the figures are not necessarily drawn to scale as one or more elements shown in the figures may be enlarged or resized to facilitate recognition and discussion.

DETAILED DESCRIPTION

As will be described herein in detail, a multipole assembly configured for use in a mass spectrometer includes a plurality of rod electrodes, each rod electrode included in the plurality of rod electrodes comprising molybdenum. A sacrificial anode is in electrical contact with a rod electrode included in the plurality of rod electrodes. The sacrificial anode has an electrochemical potential that is more negative than the electrochemical potential of the rod electrode. For example, the sacrificial anode may be formed of aluminum, magnesium, and/or zinc, each of which has an electrochemical potential that is more negative than the electrochemical potential of molybdenum. In other examples, the sacrificial anode is formed of chromium, iron, nickel, an alloy of iron and nickel, or an alloy of iron and chromium.

In some examples the multipole assembly may include a plurality of sacrificial anodes, for example, a sacrificial anode may be in electrical contact with each rod electrode or each electrically-coupled pair of rod electrodes. The multipole assemblies thus configured may be used in a mass spectrometer, for instance, as an ion guide, a mass filter, a collision cell, or an ion trap.

The multipole assemblies described herein may provide various benefits. For example, a multipole assembly having one or more sacrificial anodes in electrical contact with one or more rod electrodes may prevent, slow, or reduce galvanic corrosion of the rod electrodes when the multipole assembly is exposed to a humid environment. As a result, the multipole assembly may operate without its performance being diminished due to galvanic corrosion of the rod electrodes.

Various embodiments will now be described in more detail with reference to the figures. The exemplary multipole assemblies described herein may provide one or more of the benefits mentioned above and/or various additional and/or alternative benefits that will be made apparent herein.

Figure 1:
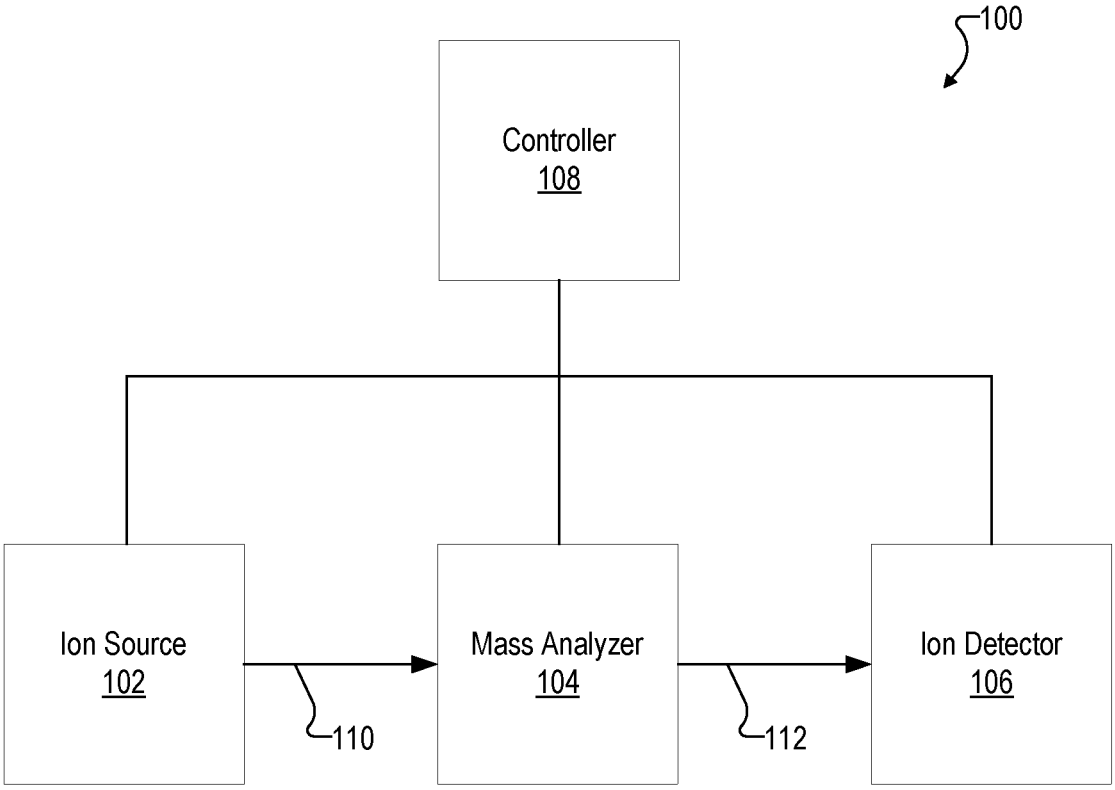
FIG. 1 illustrates an exemplary mass spectrometer according to principles described herein.

A multipole assembly described herein may be implemented as part of, or in conjunction with, a mass spectrometry system. FIG. 1 illustrates functional components of an exemplary mass spectrometry system 100 ("system 100"). System 100 is illustrative and not limiting. As shown, system 100 includes an ion source 102, a mass analyzer 104, an ion detector 106, and a controller 108.

Ion source 102 is configured to produce a plurality of ions from a sample to be analyzed and deliver the ions to mass analyzer 104. Ion source 102 may use any suitable ionization technique, including but not limited to electron ionization (EI), chemical ionization (CI), matrix assisted laser desorption/ionization (MALDI), electrospray ionization (ESI), atmospheric pressure chemical ionization (APCI), atmospheric pressure photoionization (APPI), inductively coupled plasma (ICP), and the like. Ion source 102 may focus and accelerate an ion beam 110 of produced ions from ion source 102 to mass analyzer 104.

Mass analyzer 104 is configured to separate the ions in ion beam 110 according to the ratio of mass to charge of each of the ions. To this end, mass analyzer 104 may include a quadrupole mass filter, an ion trap (e.g., a three-dimensional (3D) quadrupole ion trap, a cylindrical ion trap, a linear quadrupole ion trap, a toroidal ion trap, an orbitrap, etc.), a time-of-flight (TOF) mass analyzer, an electrostatic trap mass analyzer, a Fourier transform ion cyclotron resonance (FT-ICR) mass analyzer, a sector mass analyzer, and/or any other suitable type of mass analyzer.

In some embodiments that implement tandem mass spectrometers, mass analyzer 104 and/or ion source 102 may also include a collision cell. The term "collision cell," as used herein, is intended to encompass any structure arranged to produce product ions via controlled dissociation processes and is not limited to devices employed for collisionally-activated dissociation. For example, a collision cell may be configured to fragment the ions using collision induced dissociation (CID), electron transfer dissociation (ETD), electron capture dissociation (ECD), photo induced dissociation (PID), surface induced dissociation (SID), and any other suitable technique. A collision cell may be positioned upstream from a mass filter, which separates the fragmented ions based on the ratio of mass to charge of the ions. In some embodiments, mass analyzer 104 may include a combination of multiple mass filters and/or collision cells, such as a triple quadrupole mass analyzer, where a collision cell is interposed in the ion path between independently operable mass filters.

Ion detector 106 is configured to detect ions separated by mass analyzer 104 and responsively generate a signal representative of ion abundance. In one example, mass analyzer 104 emits an emission beam 112 of separated ions to ion detector 106, which is configured to detect the ions in emission beam 112 and generate or provide data that can be used to construct a mass spectrum of the sample. Ion detector 106 may include, but is not limited to, an electron multiplier, a Faraday cup, and any other suitable detector.

Ion source 102 and/or mass analyzer 104 may include ion optics for focusing, accelerating, and/or guiding ions (e.g., ion beam 110 or emission beam 112) through system 100. The ion optics may include, for example, an ion guide, a focusing lens, a deflector, and any other suitable device. For instance, ion source 102 may include ion optics for focusing the produced ions into ion beam 110, accelerating ion beam 110, and guiding ion beam 110 toward mass analyzer 104.

Any one or more of ion source 102, mass analyzer 104, and ion detector 106 may include a multipole assembly having a plurality of rod electrodes, as will be described below in more detail. Such a multipole assembly may, for example, form all or part of a mass analyzer (e.g., a mass filter), an ion trap, a collision cell, and/or ion optics (e.g., an ion guide). The multipole assembly may be coupled to an oscillatory voltage power supply configured to supply an RF voltage to the plurality of rod electrodes. The multipole assembly may also be coupled to a DC power supply configured to supply, for example, a mass resolving DC voltage to the plurality of rod electrodes.

Controller 108 may be communicatively coupled with, and configured to control operations of, ion source 102, mass analyzer 104, and/or ion detector 106. Controller 108 may include hardware (e.g., a processor, circuitry, etc.) and/or software configured to control operations of the various components of system 100. For example, controller 108 may be configured to enable/disable ion source 102. Controller 108 may also be configured to control the oscillatory voltage power supply and the DC power supply to supply the RF voltage and the mass resolving DC voltage, respectively, to the multipole assembly. Controller 108 may also be configured to control mass analyzer 104 by selecting an effective range of the ratio of mass to charge of ions to detect. Controller 108 may further be configured to adjust the sensitivity of ion detector 106, such as by adjusting the gain, or to adjust the polarity of ion detector 106 based on the polarity of the ions being detected.

Various embodiments of a multipole assembly that may be used in system 100 will now be described. It will be recognized that the embodiments that follow are merely exemplary and are not limiting.

Figure 2:
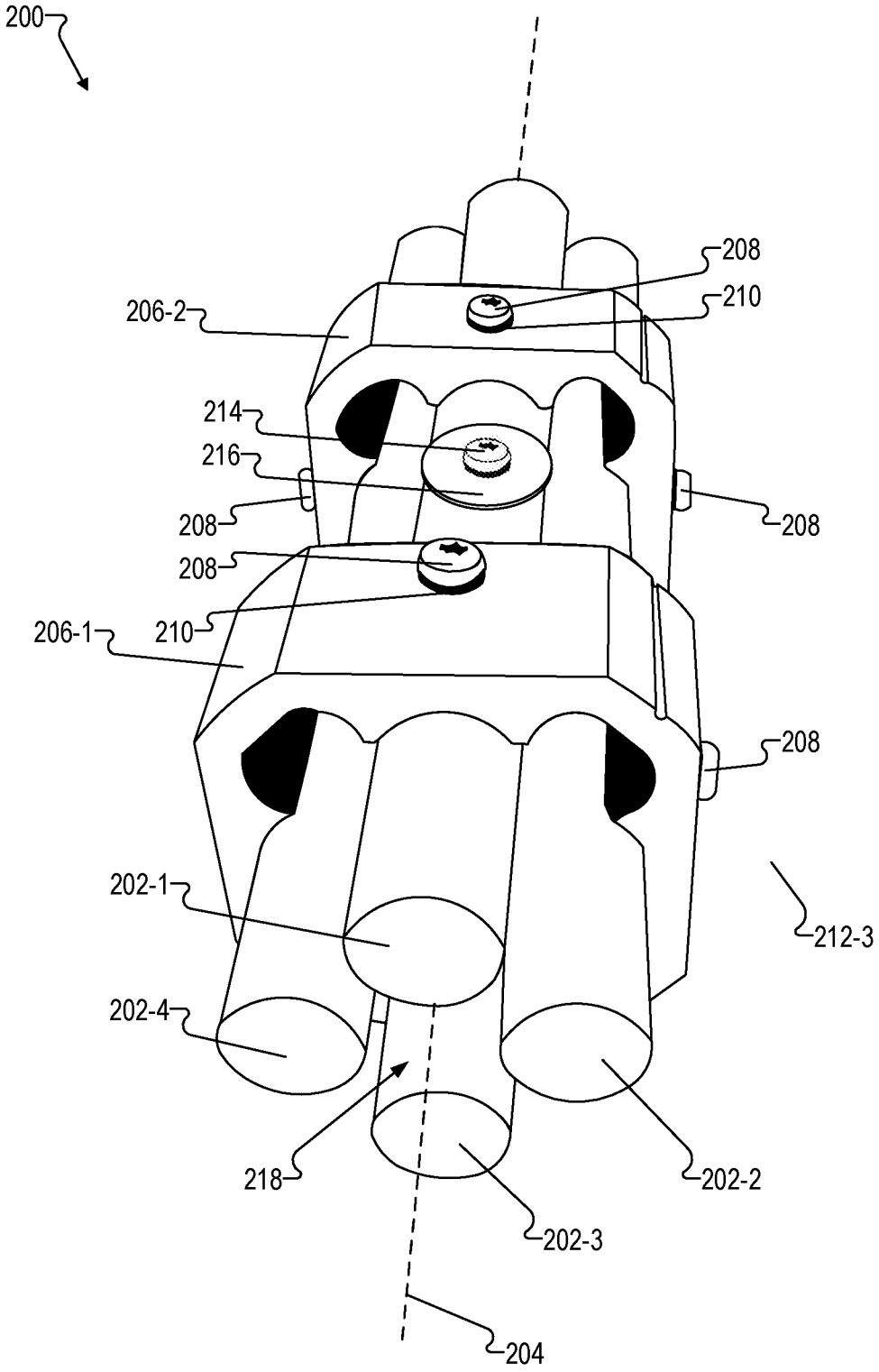
FIG. 2 illustrates a perspective view of an exemplary multipole assembly that may be included within the mass spectrometer system of FIG. 1 according to principles described herein.
Figure 3:
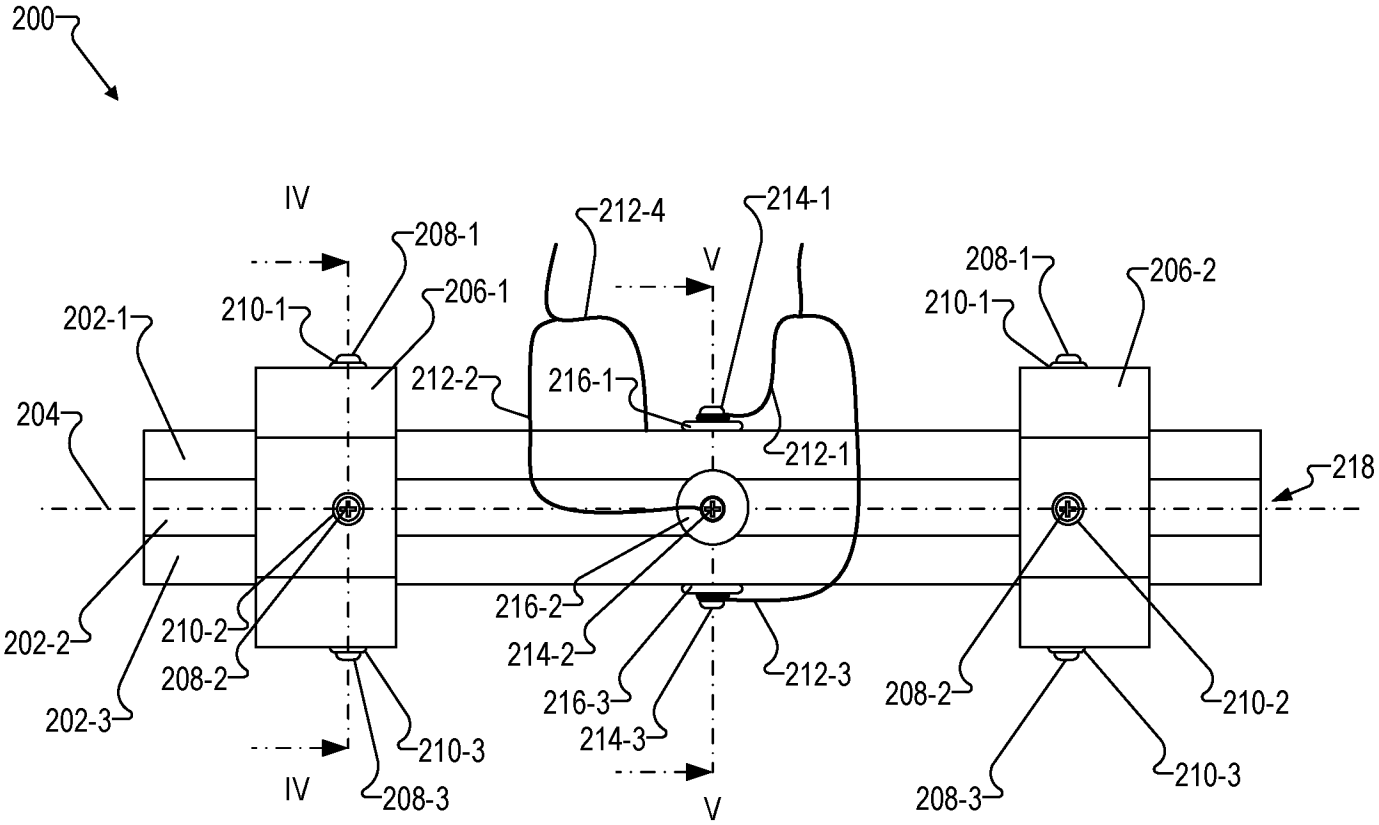
FIG. 3 illustrates a side view of the multipole assembly of FIG. 2 according to principles described herein.
Figure 4:
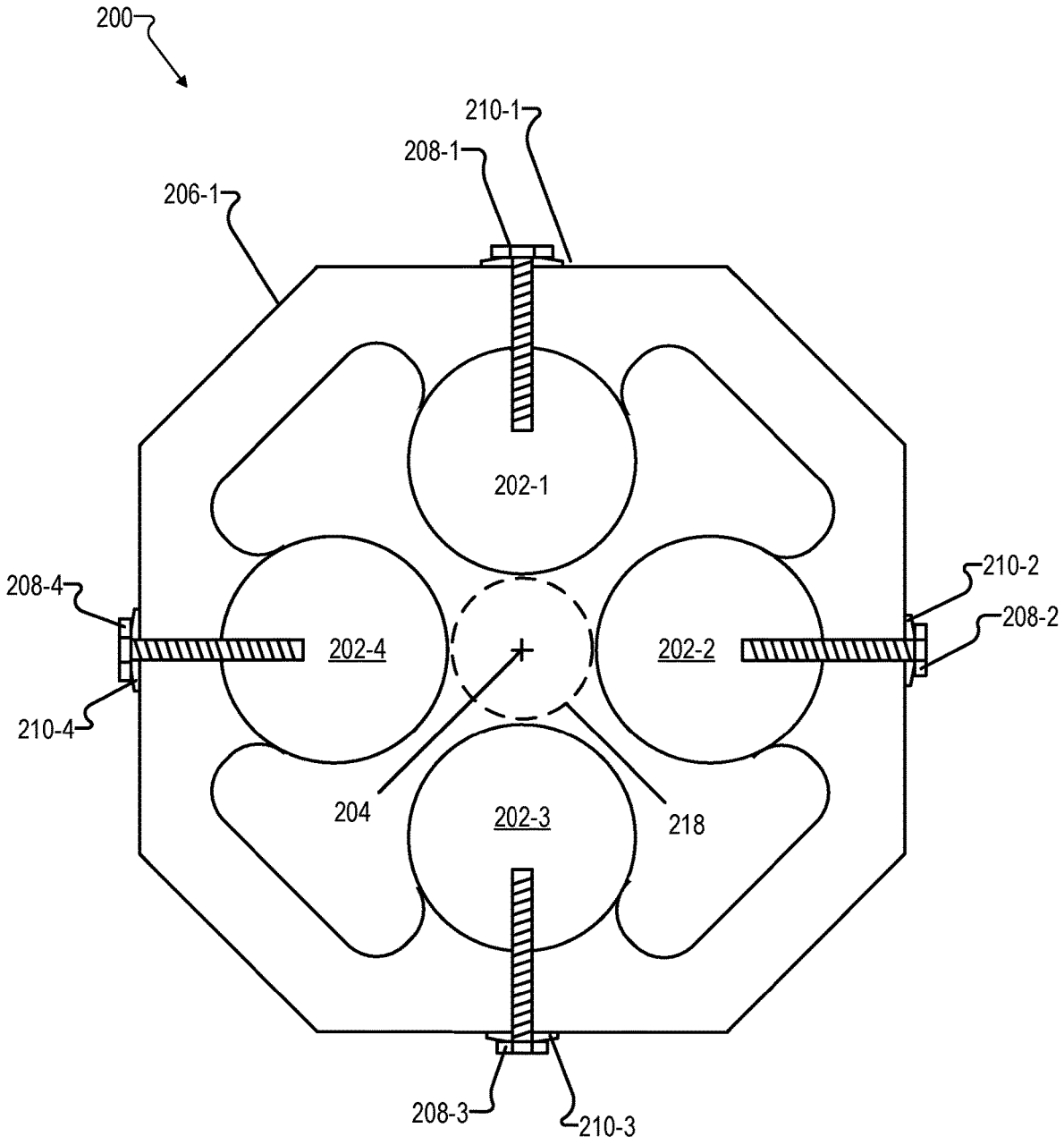
FIGS. 4 and 5 illustrate various cross-sectional views of the multipole assembly of FIG. 2 according to principles described herein.
Figure 5:
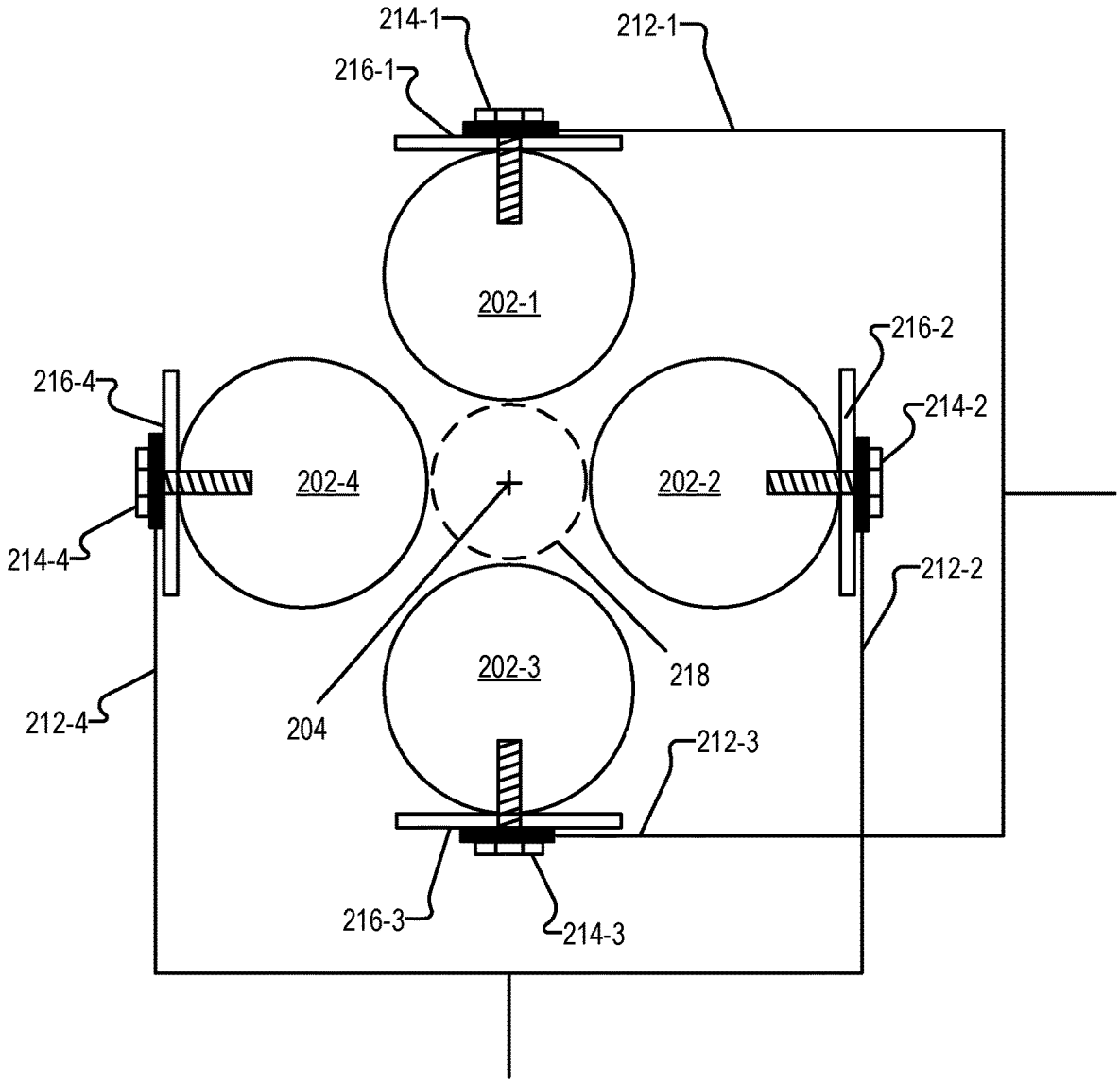

FIG. 2 illustrates a perspective view of an exemplary multipole assembly 200 that may be used in system 100. FIG. 3 illustrates a side view of multipole assembly 200, FIG. 4 illustrates a cross-sectional view of multipole assembly 200 taken along the dashed line labeled IV shown in FIG. 3, and FIG. 5 illustrates a cross-sectional view of multipole assembly 200 taken along the dashed line labeled V shown in FIG. 3. As shown in FIGS. 2-5, multipole assembly 200 is a quadrupole having four elongate rod electrodes 202 (e.g., first electrode 202-1, second electrode 202-2, third electrode 202-3, and fourth electrode 202-4) arranged about an axis 204 extending along a longitudinal trajectory of electrodes 202. It will be recognized, however, that multipole assembly 200 may alternatively be configured as any other type of multipole assembly having a larger number of electrodes, such as a hexapole assembly having six electrodes or an octapole assembly having eight electrodes.

Electrodes 202 are arranged as opposing electrode pairs across axis 204. For example, a first electrode pair includes first electrode 202-1 positioned opposite to third electrode 202-3, and a second electrode pair includes second electrode 202-2 positioned opposite to fourth electrode 202-4. Electrodes 202 may be formed of any conductive material, such as a metal (e.g., molybdenum, nickel, titanium), a metal alloy (e.g., invar, steel), and/or any other conductive material. As shown in FIGS. 2-5, electrodes 202 are round (e.g., circular). However, it will be recognized that electrodes 202 may have any other shape as may suit a particular implementation.

Multipole assembly 200 includes support members 206 (e.g., first support member 206-1 and second support member 206-2) to hold electrodes 202 in a substantially mutual parallel alignment. First support member 206-1 may be located at a proximal end portion of multipole assembly 200 (e.g., at an ion beam receiving side), and second support member 206-2 may be located at a distal end portion of multipole assembly 200 (e.g., at an ion beam emission side). Support members 206 illustrated in FIGS. 2-4 are exemplary. Additional or alternative support members 206 may be used in other examples to hold electrodes 202.

As shown in FIGS. 2-4, electrodes 202 are secured to support members 206 by support screws 208 (e.g., support screws 208-1 through 208-4) that pass through screw holes in support members 206 and engage with threaded holes in electrodes 202. Support washers 210 (e.g., support washers 210-1 through 210-4) are provided between support members 206 and support screws 208. It will be recognized that electrodes 202 may be secured to support members 206 in any other suitable way, such as by another fastener, by an adhesive, etc.

Multipole assembly 200 further includes electrical leads 212 (shown in FIGS. 3 and 5) by which an RF voltage and/or a DC voltage are applied to electrodes 202. Electrical leads 212 include a first electrical lead 212-1 connected to first electrode 202-1, a second electrical lead 212-2 connected to second electrode 202-2, a third electrical lead 212-3 connected to third electrode 202-3, and a fourth electrical lead 212-4 connected to fourth electrode 202-4. First and third electrical leads 212-1 and 212-3 are electrically connected to one another so that first electrode 202-1 and third electrode 202-3 form a first electrode pair, and second and fourth electrical leads 212-2 and 212-4 are electrically connected to one another so that second electrode 202-2 and fourth electrode 202-4 form a second electrode pair. Distal ends of electrical leads 212 are configured to be electrically connected to an oscillatory voltage power supply and/or a DC voltage power supply.

Electrical leads 212 may be electrically connected to electrodes 202 in any suitable way. For example, as shown in FIGS. 2-4, electrical leads 212 are electrically connected to electrodes 202 by way of lead screws 214 (e.g., lead screws 214-1 through 214-4) and lead washers 216 (e.g., lead washers 216-1 through 216-4). Lead screws 214 engage with threaded holes in electrodes 202 and securely hold electrical leads 212 in physical contact with lead washers 216 and electrical contact with electrodes 202. Lead screws 214 and lead washers 216 may be formed of any suitable material, such as a metal (e.g., molybdenum, nickel, titanium), a metal alloy (e.g., invar, steel), and/or any other conductive material.

When multipole assembly 200 is used in a mass spectrometry system (e.g., system 100), opposite phases of a RF voltage may be applied to the first and second pairs of electrodes 202 by way of electrical leads 212 to generate an RF quadrupolar electric field that guides or traps ions within a stability region 218 of multipole assembly 200. Stability region 218 is a region between electrode pairs 206 where ions may be confined radially about axis 204 such that the confined ions do not contact or discharge against any of electrodes 202. As the RF voltage oscillates, the ions are alternately attracted to the first electrode pair and the second electrode pair, thus confining the ions within stability region 218.

In some embodiments, multipole assembly 200 may function as a mass resolving multipole assembly configured to separate ions based on their ratio of mass to charge. Accordingly, a mass resolving DC voltage may also be applied to the electrode pairs by way of electrical leads 212, thereby superposing a constant electric field on the RF quadrupolar electric field. The constant electric field generated by the mass resolving DC voltage causes the trajectory of ions having a ratio of mass to charge outside of an effective range to become unstable such that the unstable ions eventually discharge against one of the electrodes 202 and are not detected by the ion detector (e.g., ion detector 106). Only ions having a ratio of mass to charge within the effective range maintain a stable trajectory in the presence of the mass resolving DC voltage and are confined radially about axis 204 within stability region 218, thus separating such ions to be detected by the ion detector.

The precision of the RF and DC electric fields generated by electrodes 202, and hence the quality of the data generated by the mass spectrometry system in which multipole assembly 200 is used, depends on the cleanliness, alignment, and surface geometry of electrodes 202. The tight tolerances used to generate precise electric fields are beyond the ability to discern with the naked eye, and precision tools such as laser micrometers and air gauges are often used to ensure adequate alignment of electrodes 202 to within a few micrometers.

However, the inventors have discovered that surfaces of electrodes in multipole assemblies may be galvanically corroded when in the electrodes are contact with a dissimilar metal and in the presence of gas phase water vapor (e.g., humidity). Such corrosion may occur, for example, when a multipole assembly is exposed to ambient humidity, such as when the multipole assembly is stored outside of a mass spectrometer or when the multipole assembly is disposed within a mass spectrometer that is vented to ambient air. The corrosive effects of adsorbed water on the surface geometry of the rod electrodes is negligible to the structural integrity of the rod electrodes and is generally not discernable to the naked eye. Nevertheless, such corrosion may result in diminished performance of the multipole assembly (e.g., diminished ion transmission) and, hence, diminished resolution, sensitivity, and/or mass accuracy of the mass spectrometry system in which the multipole assembly is used. Because the corrosion may not be discernible to the naked eye, the diminished performance of the multipole assembly and of the mass spectrometer may go undetected by a user.

To prevent, reduce, or slow corrosion of electrodes 202, multipole assembly 200 includes one or more sacrificial anodes in electrical contact with one or more electrodes 202. The sacrificial anodes may be positioned in any location and implemented in any form as may suit a particular implementation. In some embodiments, one or more of lead washers 216 (e.g., lead washers 216-1 through 216-4) is configured to function as a sacrificial anode. To this end, one or more of lead washers 216 is formed of a material having a more negative electrochemical potential than the electrochemical potential of the electrode 202 with which the lead washer 216 is in electrical contact. As used herein, "electrochemical potential" refers to the standard reduction potential E° at a temperature of 25° C. and a pressure of one (1.0) atm.

In some examples, rod electrodes 202 are formed of molybdenum, which has an electrochemical potential E° of −0.200 V. Accordingly, lead washers 216 functioning as sacrificial anodes may be formed of any electrically conductive material having an electrochemical potential that is less than −0.200 V. Given that lead washers 216 also help lead screws 214 maintain electrical leads 212 in electrical contact with electrodes 202, lead washers 216 may preferably be formed of a relatively soft metal or metal alloy while having a suitably high electrical conductivity. In some examples lead washers 216 are formed of a material comprising at least one of magnesium (E°=−2.372 V), aluminum (E°=−1.662 V), and zinc (E°=−0.762 V). In other examples lead washers 216 are formed of a material comprising at least one of iron (E°=0.447 V), nickel (E°=−0.257 V), chromium (E°=−0.744 V), and an alloy of any one or more of the foregoing (e.g., an iron-nickel alloy, an iron-chromium alloy, etc.).

Because the sacrificial anodes have a more negative electrochemical potential than electrodes 202, oxidation in galvanic corrosion occurs at the sacrificial anodes while reduction occurs at electrodes 202. Accordingly, corrosion occurs at the sacrificial anodes (lead washers 216) rather than at the surface of electrodes 202. Additionally, even if the proximal ends of electrical leads 212 (i.e., the ends of electrical leads 212 connected to electrodes 202 by lead screws 214) are formed of a material that has a more positive electrochemical potential than molybdenum (e.g., copper, E°=+0.342 V), the proximal ends of electrical leads 212 are in direct contact with the sacrificial anodes, which have a more negative electrochemical potential than electrical leads 212. Therefore, galvanic corrosion is more likely to occur at the sacrificial anodes than at electrodes 202.

As shown in FIGS. 2-5, each of lead washers 216 is a sacrificial anode. Accordingly, multipole assembly 200 includes a first sacrificial anode (lead washer 216-1) in electrical contact with first electrode 202-1, a second sacrificial anode (lead washer 216-2) in electrical contact with second electrode 202-2, a third sacrificial anode (lead washer 216-3) in electrical contact with third electrode 202-3, and a fourth sacrificial anode (lead washer 216-4) in electrical contact with fourth electrode 202-4. Lead washers 216 are shown to be larger in diameter than support washers 210 and larger than what may otherwise be necessary for screws 214 to secure electrical leads 212 in contact with electrodes 202. Accordingly, lead washers 216 have a large surface area, which may aid and prolong the galvanic protection of electrodes 202. However, lead washers 216 may be any size as may suit a particular implementation.

Figure 6:
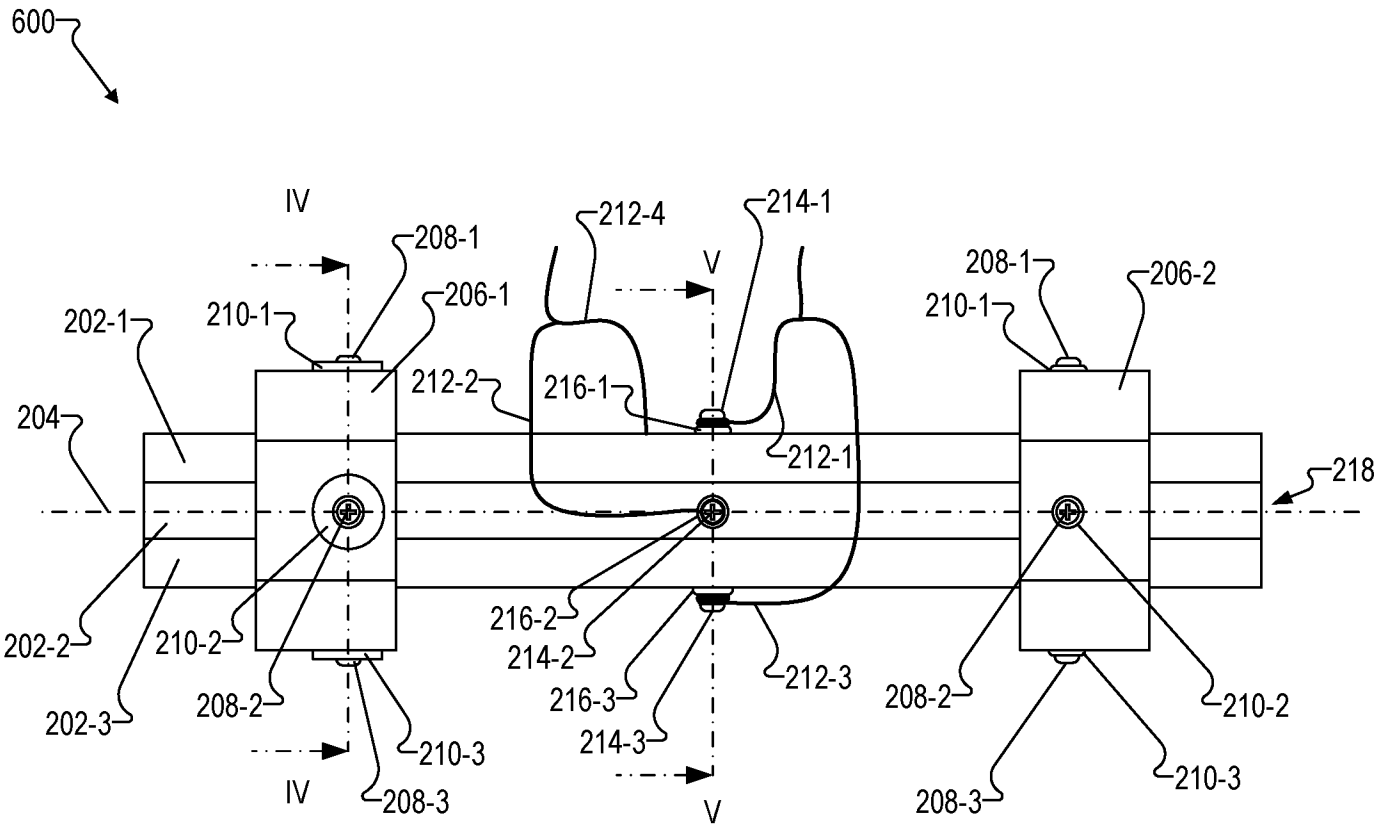
FIG. 6 illustrates a side view of another exemplary multipole assembly according to principles described herein.
Figure 7:
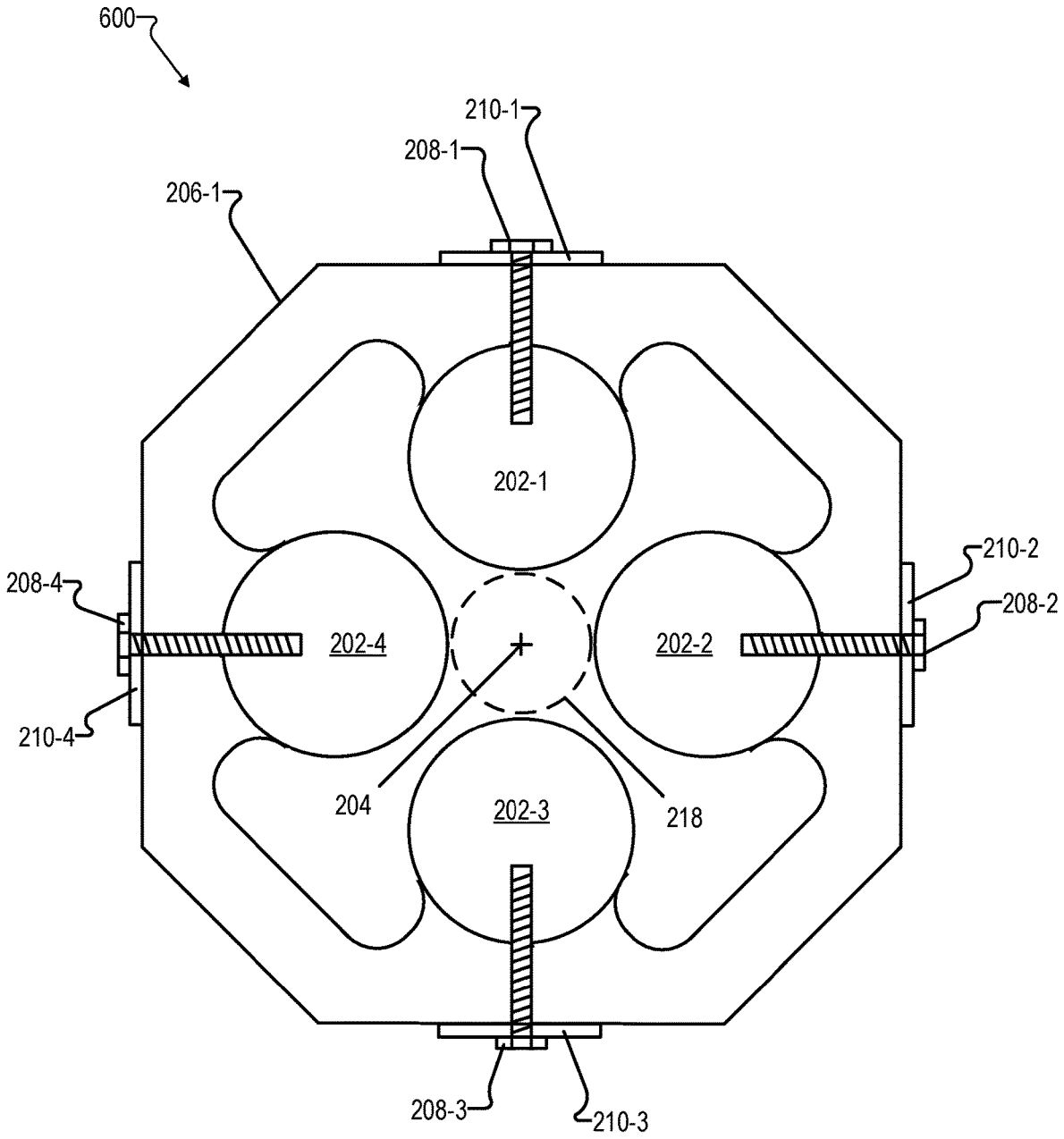
FIG. 7 illustrates a cross-sectional view of the multipole assembly of FIG. 6 according to principles described herein.

It will be recognized that the foregoing embodiments are merely illustrative and not limiting as various modifications may be made within the scope of this disclosure. In some embodiments, multipole assembly 200 may include sacrificial anodes positioned additionally or alternatively at any other location as may suit a particular implementation. For example, FIGS. 6 and 7 illustrate another exemplary multipole assembly 600. FIG. 6 is the same as FIG. 3, and FIG. 7 is the same as FIG. 4, except that sacrificial anodes are implemented by support washers 210 (e.g., support washers 210-1 through 210-4) of support member 206-1 instead of lead washers 216. The sacrificial anodes (support washers 210) are in electrical contact with electrodes 202 by way of support screws 208 (e.g., support screws 208-1 through 208-4), as shown in FIG. 7.

Figure 8:
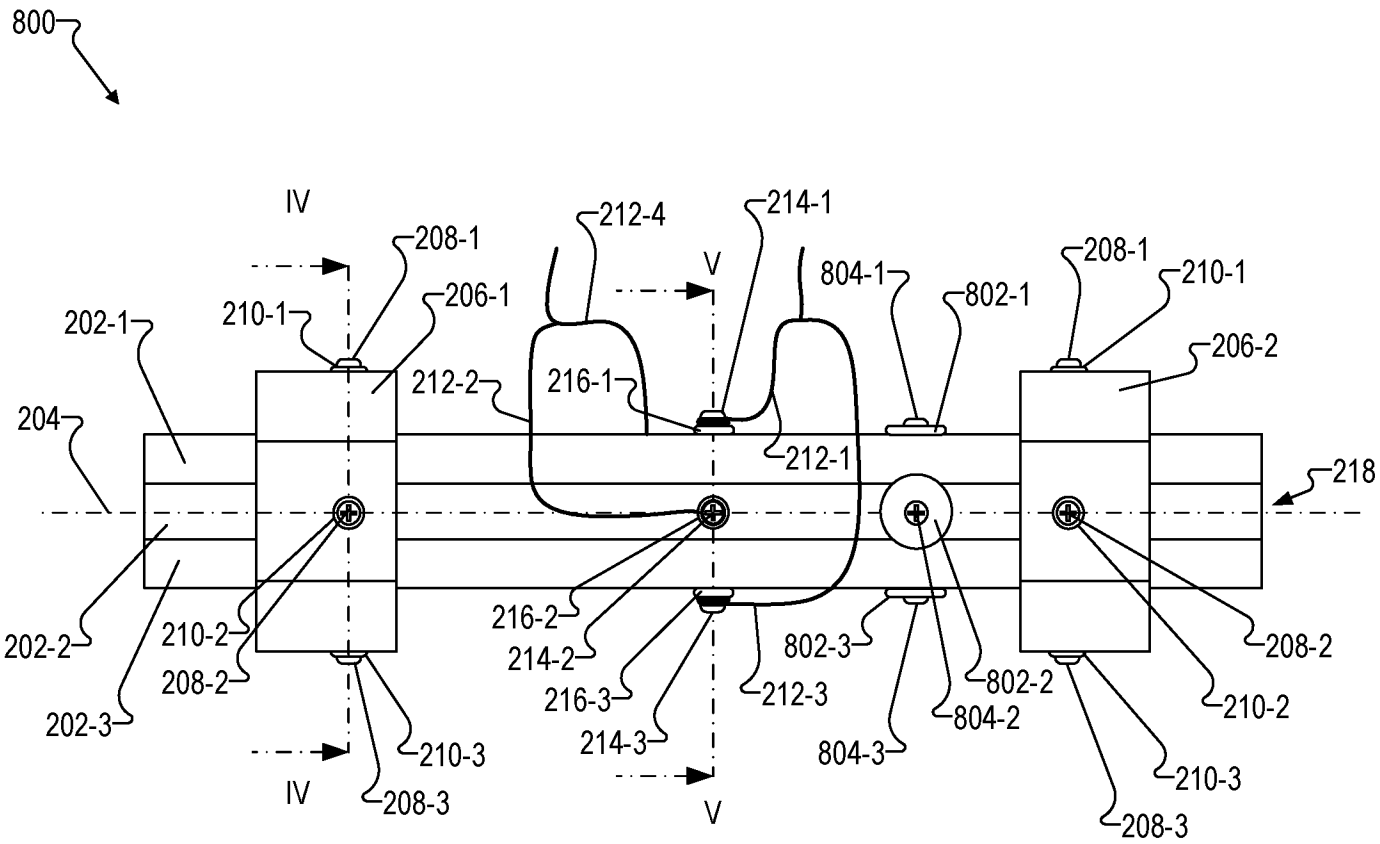
FIG. 8 illustrates a side view of another exemplary multipole assembly according to principles described herein.

FIG. 8 illustrates another exemplary multipole assembly 800. FIG. 8 is the same as FIG. 3 except that multipole assembly 800 includes sacrificial anodes 802 (e.g., sacrificial anodes 802-1 through 802-3) separate from washers 216. Sacrificial anodes 802 are attached to electrodes 202 at locations other than at the point of connection of electrical leads 212 to electrodes 202. For example, as shown in FIG. 8, sacrificial anodes 802 are attached to side surfaces of electrodes 202 at locations between second support member 206-2 and the point of connection of electrical leads 212 to electrodes 202. However, sacrificial anodes 802 may additionally or alternatively be connected to electrodes 202 at any other location as may suit a particular implementation, including other locations on the side surfaces and/or end faces of electrodes 202.

Sacrificial anodes 802 are attached to electrodes by way of screws 804 (e.g., screws 804-1 through 804-3). Screws 802 and lead washers 216 may be made of any suitable material, such as a metal (e.g., molybdenum, nickel, titanium), a metal alloy (e.g., invar, stainless steel), and/or any other conductive material.

While multipole assemblies 200, 600, and 800 described above include one sacrificial anode in electrical contact with each electrode 202, the multipole assemblies are not limited to this configuration but may have any number of sacrificial anodes in electrical contact with each electrode 202 as may suit a particular implementation. For example, a multipole assembly may include multiple sacrificial anodes in electrical contact with each electrode 202. The sacrificial anodes may be positioned at any suitable location and configured in based on any combination of the configurations described above with respect to multipole assemblies 200, 600, and 800.

Figure 9:
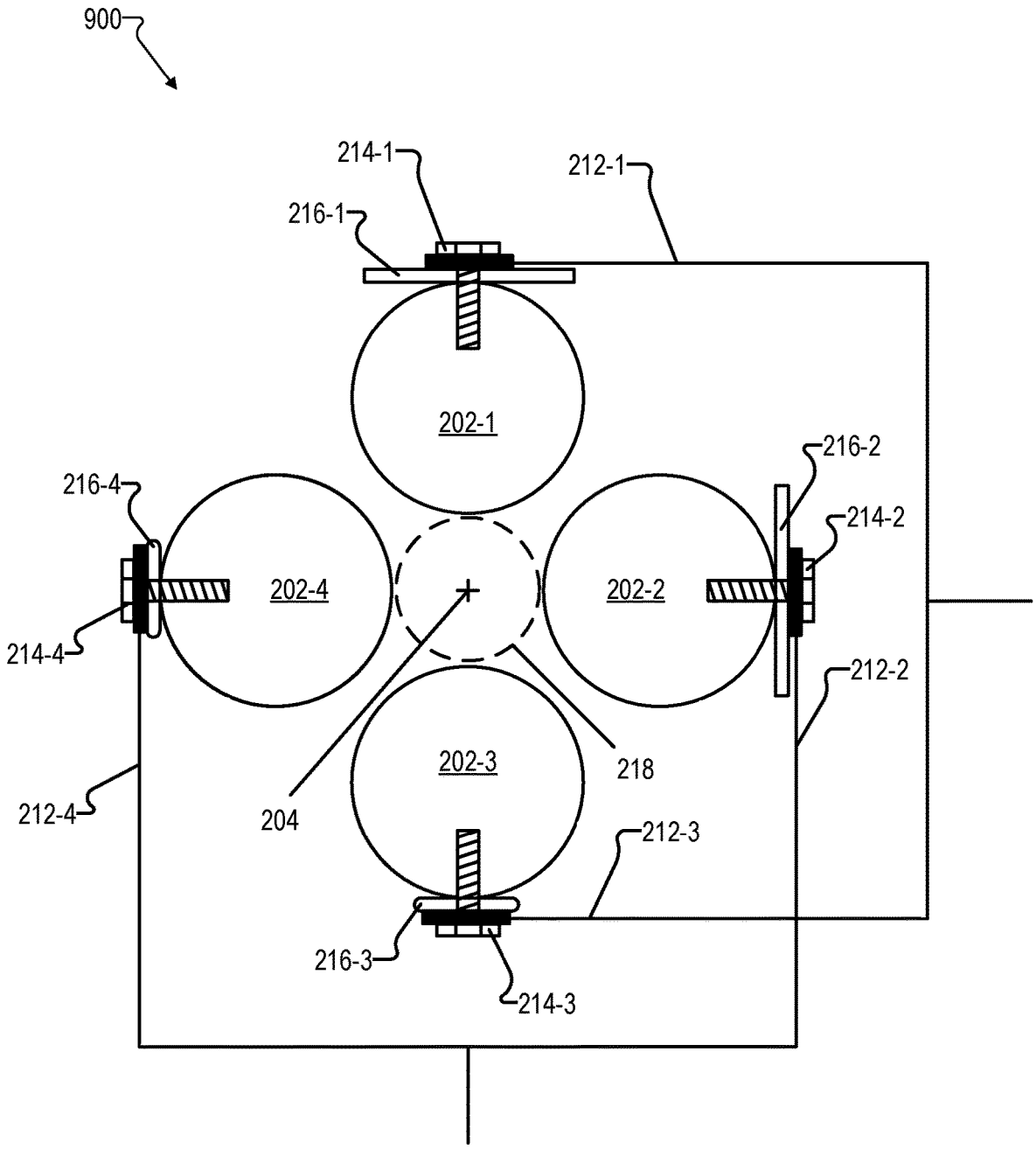
FIG. 9 illustrates a cross-sectional view of another exemplary multipole assembly according to principles described herein.

FIG. 9 illustrates another exemplary multipole assembly 900. FIG. 9 is the same as FIG. 5 except that multipole assembly 900 includes only one sacrificial anode in electrical contact with each electrode pair. For example, a first sacrificial anode is implemented by washer 216-1 and is in electrical contact with first electrode 202-1 by direct contact and/or by lead screw 214-1 and is in electrical contact with third electrode 202-3 by way of electrical leads 212-1 and 212-3. Similarly, a second sacrificial anode is implemented by washer 216-2 and is in electrical contact with second electrode 202-2 by direct contact and/or by lead screw 214-2 and is in electrical contact with fourth electrode 202-4 by way of electrical leads 212-2 and 212-4. Thus, the first and second sacrificial anodes (e.g., lead washers 216-1 and 216-2) may prevent galvanic corrosion of all of electrodes 202.

Figure 10:
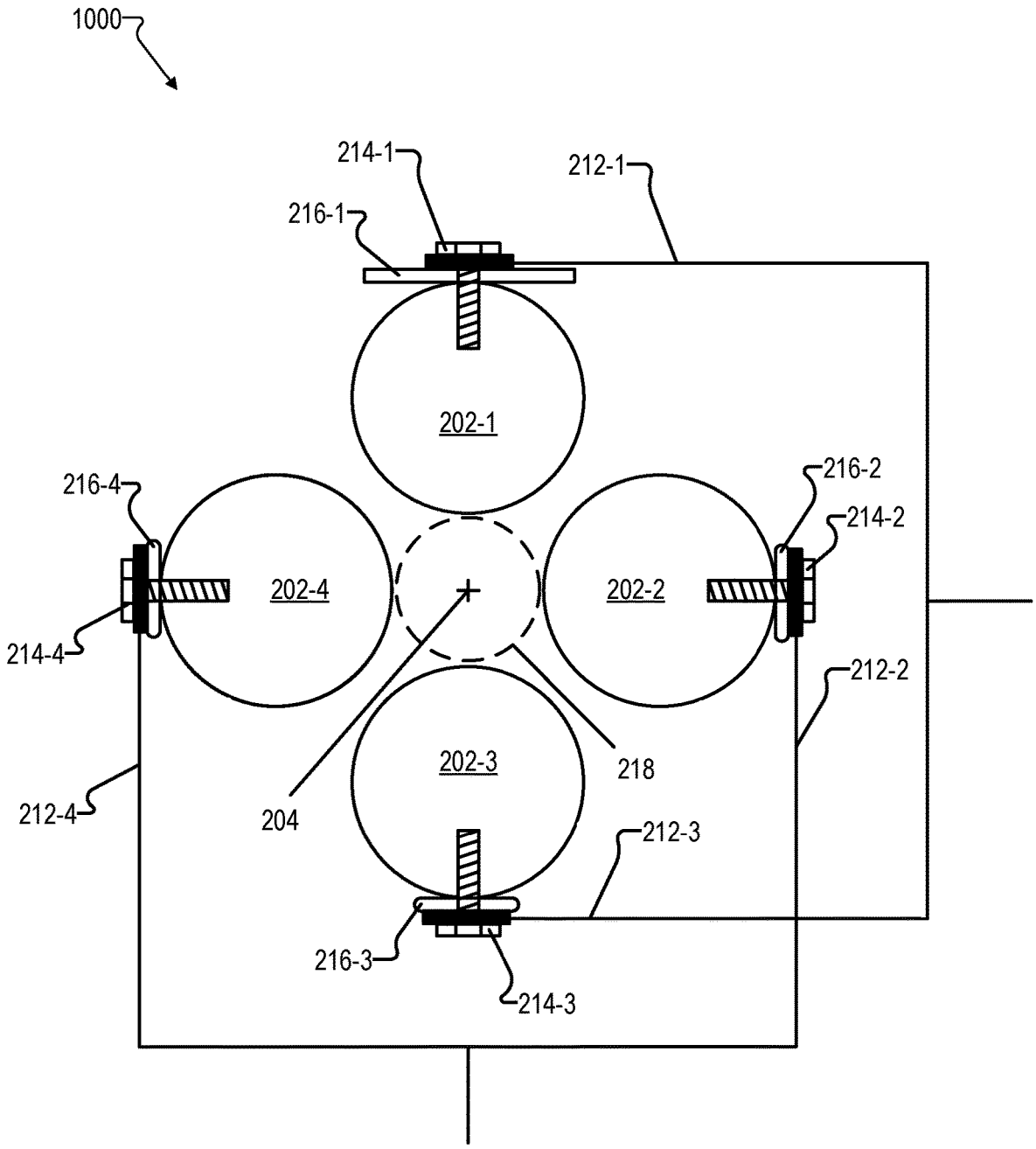
FIG. 10 illustrates a cross-sectional view of another exemplary multipole assembly according to principles described herein.

FIG. 10 illustrates another exemplary multipole assembly 1000. FIG. 1000 is the same as FIG. 5 except that multipole assembly 1000 includes only one sacrificial anode. For example, a sacrificial anode is implemented by washer 216-1 and is in electrical contact with first electrode 202-1 by direct contact and/or by lead screw 214-1 and is in electrical contact with third electrode 202-3 by way of electrical leads 212-1 and 212-3. Thus, the sacrificial anode (e.g., lead washer 216-1) may prevent galvanic corrosion of at least first electrode 202-1 and third electrode 202-3.

Figure 11:
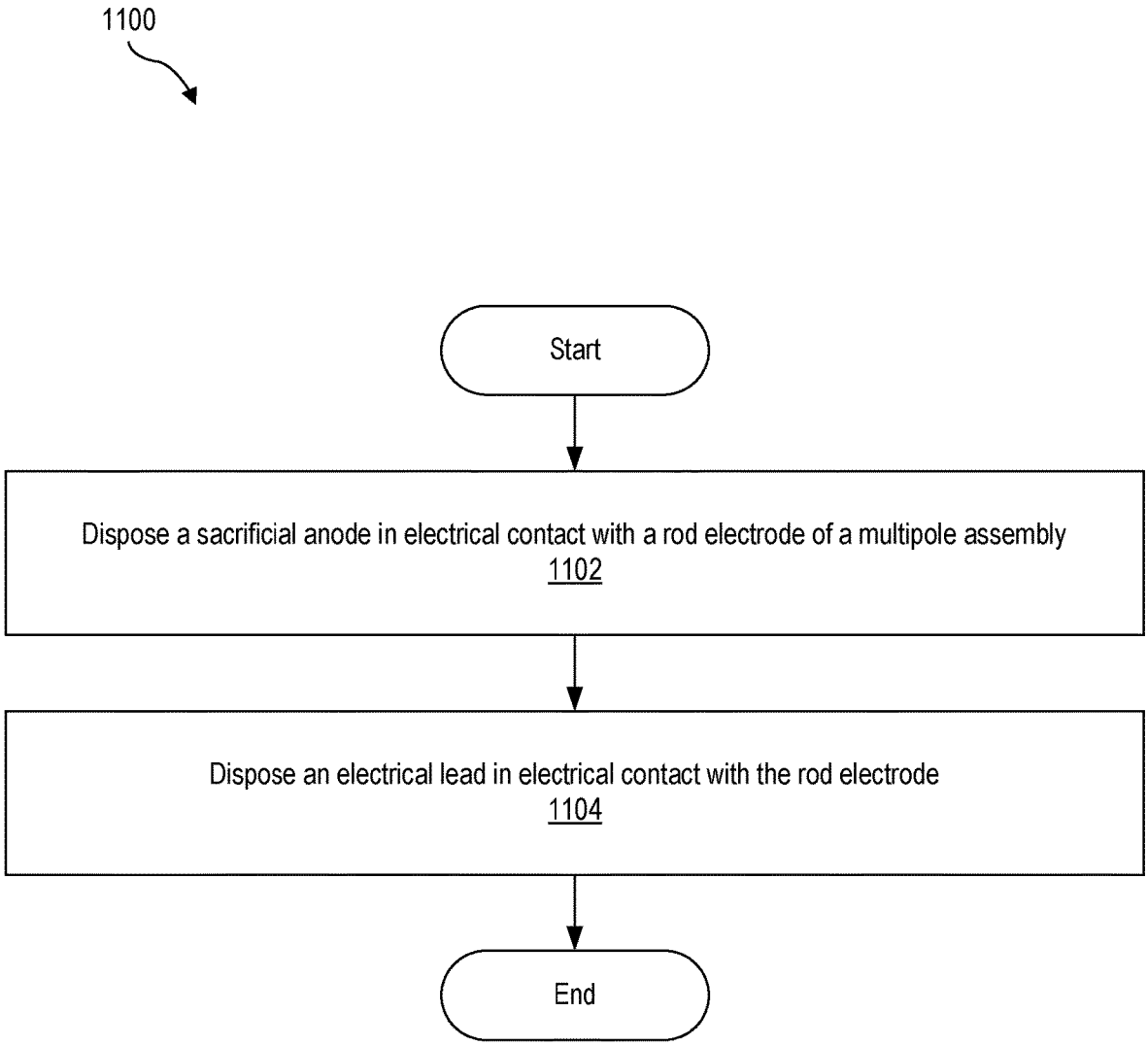
FIG. 11 illustrates an exemplary block diagram for assembling an exemplary multipole assembly according to principles described herein.

The use of sacrificial anodes as described above can also provide for easy assembly of the previously discussed multipole assemblies. FIG. 11 illustrates an exemplary block diagram for assembling an exemplary multipole assembly according to principles described herein. While FIG. 11 illustrates exemplary steps according to one embodiment, other embodiments may omit, add to, reorder, combine, and/or modify any of the steps shown in FIG. 11.

In step 1102, a sacrificial anode may be disposed in electrical contact with a rod electrode of a multipole assembly. For example, in FIG. 5, sacrificial anodes 216-1 to 216-4 are disposed, or placed, upon electrodes 202-1 to 202-4, respectively, that include molybdenum.

Returning to FIG. 11, in step 1104 electrical leads may be disposed in electrical contact with the rod electrodes. For example, in FIG. 5, electrical leads 212-1 to 212-4 are positioned adjacent to the respective sacrificial anodes 216-1 to 216-4 and secured in position using screws 214-1 to 214-4, as previously discussed. This allows for electrical leads 212-1 to 212-4 to be electrically coupled with electrodes 202-1 to 202-4, respectively.

In a multipole assembly thus assembled, the electrical leads may be driven by the appropriate circuitry to provide electrical signals to allow for the multipole assembly to generate the appropriate electric fields to guide, trap, and/or filter ions. Because the electrochemical potential of the sacrificial anodes is different than the electrochemical potential of the electrodes, and in particular a more negative electrochemical potential, galvanic corrosion is more likely to occur at the sacrificial anodes than the electrodes.

In the embodiments described above the sacrificial anodes are implemented by a washer. However, the sacrificial anodes are not limited to this configuration but may be implemented by any other device and have any other structure or form as may suit a particular implementation. For example, any one or more of the sacrificial anodes described herein may alternatively be in the form of a pad, a strip, a bar, a wire, a plate, a rod, or any other suitable structure. Additionally, the sacrificial anodes may be connected to electrodes 202 in any suitable way, whether directly such as by a fastener (e.g., a screw), a conductive adhesive, solder, a weld, etc., or indirectly such as by a wire or other conductive connection.

More generally, in the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A multipole assembly configured to be disposed in a mass spectrometer, the multipole assembly comprising:

a plurality of rod electrodes, each rod electrode included in the plurality of rod electrodes comprising molybdenum; and a sacrificial anode in electrical contact with a rod electrode included in the plurality of rod electrodes, wherein the sacrificial anode comprises a material having an electrochemical potential that is more negative than the electrochemical potential of the rod electrode.

2. The multipole assembly of claim 1, wherein the material comprises at least one of: magnesium, aluminum, or zinc.

3. The multipole assembly of claim 1, wherein the material comprises at least one of: chromium, iron, nickel, or an alloy thereof.

4. The multipole assembly of claim 1, wherein the sacrificial anode is in physical contact with a side surface of the rod electrode.

5. The multipole assembly of claim 1, wherein the sacrificial anode comprises a washer and is attached to the rod electrode by a screw.

6. The multipole assembly of claim 1, further comprising an electrical lead electrically connected to the rod electrode and configured to supply a radio frequency voltage to the rod electrode, wherein the sacrificial anode is disposed between the rod electrode and the electrical lead.

7. The multipole assembly of claim 1, further comprising a support member configured to hold the plurality of rod electrodes, wherein each rod electrode included in the plurality of rod electrodes is secured to the support member by a screw, and the support member is disposed between the rod electrode and the sacrificial anode.

8. The multipole assembly of claim 1, further comprising a plurality of sacrificial anodes in electrical contact with the plurality of rod electrodes, the plurality of sacrificial anodes including the sacrificial anode.

9. The multipole assembly of claim 1, wherein:

the plurality of rod electrodes includes a first pair of rod electrodes including the rod electrode and a second rod electrode positioned opposite to the rod electrode and electrically connected to the rod electrode, and a second pair of electrodes including a third rod electrode and a fourth rod electrode positioned opposite to the third rod electrode and electrically connected to the third rod electrode, and the multipole assembly further comprises an additional sacrificial anode in electrical contact with the third rod electrode.

10. The multipole assembly of claim 1, wherein the multipole assembly is included in an ion guide, a mass filter, a collision cell, or an ion trap.

11. The multipole assembly of claim 1, wherein the multipole assembly comprises a quadrupole, a hexapole, or an octapole.

12. A mass spectrometry system comprising:

a multipole assembly comprising a plurality of rod electrodes, each rod electrode included in the plurality of rod electrodes comprising molybdenum; and a sacrificial anode in electrical contact with a rod electrode included in the plurality of rod electrodes, wherein the sacrificial anode comprises a material having an electrochemical potential that is more negative than the electrochemical potential of the rod electrode.

13. The mass spectrometry system of claim 12, wherein the material comprises at least one of: magnesium, aluminum, or zinc.

14. The mass spectrometry system of claim 12, wherein the material comprises at least one of: chromium, iron, nickel, or an alloy thereof.

15. The mass spectrometry system of claim 12, wherein the sacrificial anode comprises a washer and is attached to the rod electrode by a screw.

16. The mass spectrometry system of claim 12, wherein the multipole assembly further comprises an electrical lead electrically connected to the rod electrode and configured to supply a radio frequency voltage to the rod electrode, wherein the sacrificial anode is disposed between the rod electrode and the electrical lead.

17. The mass spectrometry system of claim 12, wherein the multipole assembly further comprises a plurality of sacrificial anodes in electrical contact with the plurality of rod electrodes, the plurality of sacrificial anodes including the sacrificial anode.

18. The mass spectrometry system of claim 12, further comprising:

an ion source configured to produce ions from a sample;

a mass analyzer configured to filter the ions produced from the sample; and a detector configured to detect ions delivered from the mass analyzer.

19. The mass spectrometry system of claim 18, wherein the multipole assembly comprises an ion guide included in the ion source.

20. A method comprising:

disposing a sacrificial anode in electrical contact with a rod electrode of a multipole assembly, the rod electrode including molybdenum, the sacrificial anode having a first electrochemical potential, the rod electrode having a second electrochemical potential, and the first electrochemical potential being more negative than the second electrochemical potential; and disposing an electrical lead in electrical contact with the rod electrode, the sacrificial anode being positioned between the rod electrode and the electrical lead.

* * * * *